US010281115B1

(12) United States Patent
Nevitt

(10) Patent No.: US 10,281,115 B1
(45) Date of Patent: May 7, 2019

(54) QUICK-CHANGE LIGHTING ASSEMBLY AND METHOD OF USE

(71) Applicant: Thomas Anthony Nevitt, Dallas, TX (US)

(72) Inventor: Thomas Anthony Nevitt, Dallas, TX (US)

( * ) Notice: Subject to any disclaimer, the term of this patent is extended or adjusted under 35 U.S.C. 154(b) by 18 days.

(21) Appl. No.: 15/804,564

(22) Filed: Nov. 6, 2017

(51) Int. Cl.
*F21V 17/16* (2006.01)
*F21V 19/04* (2006.01)
*F21V 17/00* (2006.01)
*F21S 8/02* (2006.01)

(52) U.S. Cl.
CPC ..... *F21V 17/002* (2013.01); *F21S 8/026* (2013.01); *F21V 17/16* (2013.01); *F21V 17/162* (2013.01); *F21V 19/04* (2013.01)

(58) Field of Classification Search
CPC ..... F21V 17/002; F21V 17/16; F21V 17/162; F21V 19/04; F21S 8/026
See application file for complete search history.

(56) References Cited

U.S. PATENT DOCUMENTS 4,242,726 A 12/1980 Steadman
4,272,802 A 6/1981 Steadman
4,392,192 A 7/1983 Steadman
5,003,441 A 3/1991 Crowe et al.
5,683,176 A 11/1997 Clendenin
5,765,453 A * 6/1998 Mims ..... F21V 19/04 294/210
6,059,422 A * 5/2000 Fischer ..... F21S 8/04 362/147
6,644,831 B2 * 11/2003 Simon ..... F21V 5/046 362/157
7,334,503 B1 * 2/2008 Newman ..... H01K 3/32 294/184
7,540,637 B1 6/2009 Williams
7,645,047 B2 1/2010 Martinez
2001/0033487 A1 10/2001 Crelin
2011/0075423 A1 3/2011 Van De Ven
2014/0163664 A1 * 6/2014 Goldsmith ..... A61B 17/00491 623/1.11
2015/0092423 A1 * 4/2015 Kaner ..... F21V 17/002 362/362
2015/0098232 A1 4/2015 Nevitt
2016/0341376 A1 * 11/2016 Feit ..... F21K 9/237

* cited by examiner

*Primary Examiner* — Alan B Cariaso
(74) *Attorney, Agent, or Firm* — Fish & Richardson P.C.

(57) ABSTRACT

A quick-change lighting assembly includes a stationary ring, a plurality of clips, and a compression ring arranged between the stationary ring and the clips. Each clip has a retaining end and moves between a retaining and a releasing position, whereby the retaining end is deflected against the compression member when moving from the retaining position to the releasing position. The compression member can move towards the stationary member from an extended position, such that movement of the clips moves the compression member from the extended position to a first position. The clips accept a flange of a socket assembly, the flange defects the retaining ends from the retaining position to the releasing position until the flange directly engages the compression member and further translates the compression member to a second compressed position and the clips return to the retaining position below the flange.

26 Claims, 14 Drawing Sheets

QUICK-CHANGE LIGHTING ASSEMBLY AND METHOD OF USE

TECHNICAL FIELD

This description relates a quick-change lighting assembly that enables easy installation and removal of a socket assembly in a quick change assembly.

BACKGROUND

Illumination devices, such as light bulbs and light emitting diodes (LEDs), are a ubiquitous component of modern life, and many of these devices are installed in elevated or similarly difficult-to-access locations. Sometimes this is done to cast light over a wider area or simply to place the illumination device in a location that is out of the way (e.g., recessed in a ceiling or above a gymnasium). However, in almost all instances, these illumination devices have a limited lifespan, and the ability to be replaced is an integral, if often difficult, requirement for any assembly including such a device. As a result, it is often necessary to elevate a worker, or use an extending tool, to remove an old illumination device and install its replacement.

SUMMARY

Certain aspects of the present disclose relate to a quick-change assembly for removeably securing a socket assembly that may carry, for example, an illumination device or another electronic device such as a surveillance camera. Certain examples enable a socket assembly to be easily inserted into the quick-change assembly with a single motion, after which the quick-change assembly secures the socket assembly in a robust manner. Once secured, the socket assembly can be removed from the quick-change assembly by inserting a specifically shaped tool that disengages the socket assembly from the quick-change assembly with a single motion. In some embodiments, the quick-change assembly includes a housing element that in combination forms a quick-change housing. In some instances, the quick-change assembly further includes electrical contacts for engaging similar electrical contacts on the socket assembly, which provide power via the quick-change assembly to the socket assembly to the attached illumination device. In some instances, the socket assembly is installed with the aid of a tool as well, where the installation tool and the removal tool are similarly shaped (e.g., a cylinder and ring), where the removal tool is a slightly larger version of the installation tool. In some instances, the installation tool is a cup or ring that holds the socket assembly and is used to place the socket assembly into the quick-change housing, after which the installation tool is removed from the quick-change housing and the socket assembly in secured in place. In some instances, the removal tool is a cup or ring of a slightly larger diameter than the installation tool, and is placed around the socket assembly during insertion of the removal tool into the quick-change housing, where the removal tool is configured to, during the insertion movement into the quick-change housing, disconnect the socket assembly from the quick-change housing and allow the removal tool to carry the disconnected socket assembly away from the quick-change housing. One advantage of the above examples is the ability to install and remove a socket assembly from an overhead location using a pole or other extending tool having either a swappable removal and installation tool on the end, or a tool able to be reconfigured from an installation shape to the larger removal shape, such that a user can, with a single movement, install a socket assembly into an overhead quick-change housing by placing the socket assembly into the installation tool and pushing the socket assembly into the quick-change housing. Similarly, a use can remove the socket assembly from the quick-change housing by pushing the removal tool into the quick-change housing to release the socket assembly and allow the removal tool to carry the socket assembly away from the quick-change housing.

An example of the present disclosure is a quick-change lighting assembly configured to be inserted into a housing. The quick-change lighting assembly includes a quick-change assembly and a socket assembly. The socket assembly includes a body with a flange and a socket adapted to receive an illumination device. The quick-change assembly includes a stationary member defining a central axis, a plurality of clips, and a compression member arranged between the stationary member and the plurality of clips along the central axis. Each clip defines a retaining end and the clips are configured to move between a retaining position and a releasing position such that the retaining end of the clips are deflected in a direction radially outward from the central axis and upward when moving from the retaining position to the releasing position. The compression member is moveably coupled to the stationary member and configured to translate along the central axis towards the stationary member from an extended position. In some instances, movement of the plurality of clips from the retaining position to the releasing position causes translation of the compression member from the extended position to an initial compressed position. The plurality of clips are configured to accept a flange of a socket assembly inserted into the quick-change assembly from below, the flange deflecting the retaining ends of the plurality of clips from the retaining position to the releasing position until the flange directly engages the compression member and translates the compression member to a final compressed position such that, in the final compression position, the retaining ends of the plurality of clips return to the retaining position below the flange and secure the flange between the retaining ends and the compression member.

In some instances, the stationary member includes a plurality of carrier arms that extend in a downward direction from the stationary member, where each of the plurality of clips is attached one of the plurality of carrier arms.

In some instances, the quick-change assembly includes a spring element configured to bias the compression ring in the extended position and configured to enable translation of the compressing member towards the stationary member along the central axis against a restoring force of the spring element.

In some instances, each of the plurality of clips comprises a spring element biasing the clip in retaining position.

In some instances, each of the plurality of clips are configured to return to the retaining position using gravity In some instances, each of the plurality of clips defines a bracing end opposite the retaining end and an axis of rotation between the retaining end and the bracing end, where the clips are configured to rotate about the axis of rotation between the retaining position and the releasing position, and where the bracing end is configured to stop rotation of the clip in the retaining position. In some instances, the bracing end of the clips comprises a surface configured to abut the carrier arm or an inner surface of a housing in which the quick-change assembly is disposed to stop rotation of the clip beyond the retaining position. In some instances, each of the plurality of clips defines an inner surface defining a depression located above the axis of rotation, the depression configured to accept an edge of the flange of the socket assembly and enable the flange of the socket assembly to deflect the clip at location higher above the axis of rotation compared to a flat inner surface In some instances, the compression member defines a circular peripheral shape and the stationary member defines a circular peripheral shape, where the quick-change assembly is configured to be installed in a circular housing.

In some instances, the retaining ends of the plurality of clips define an opening of a first width in the retaining position and an opening of a second width in the releasing position, where the second width is larger than the first width, and where flange of the socket assembly is larger than the first width and smaller than or equal to the second width. In some instances, the first width is a first diameter of the opening defined by the plurality of clips in the retaining position and where the second width is a second diameter of the opening defined by the plurality of clips in the releasing position. In some instances, the compression member comprises a compression ring defining a central opening configured to accept a portion the socket assembly extending above the flange, and where the central opening defines a diameter less than the second diameter of the opening defined by the plurality of clips in the releasing position.

In some instances, the compression member defines a central opening configured to accept a portion the socket assembly extending above the flange. In some instances, the stationary member defines a central opening configured to accept the portion of the socket assembly extending above the flange. In some instances, the compression member comprises a compression ring.

In some instances, the stationary member defines a peripheral edge and where the carrier arms extend from the stationary member at the peripheral edge.

In some instances, the retaining ends of the plurality of clips are configured to be deflected by a body of the socket assembly prior to being further deflected by the flange of the socket assembly, where the body of the socket assembly defines a width less than a width of the flange of the socket assembly.

In some instances, the retaining ends of the plurality of clips define a flat surface having a rounded inner edge, the flat surface configured to abut the compression member in the retaining position and the rounded inner edge configured to abut the compression member in the releasing position, the rounded inner edge moving radially across the compression member between the retaining position and the releasing position.

In some instances, the compression member defines a plurality of passageways though which the carrier arms extend below the compression member and enable the compression member to translate along the central axis with respect to the carrier arms.

In some instances, when the flange of the socket assembly is disposed between the retaining end of the plurality of clips and the compression member, the plurality of clips are configured to move from the retaining position to the releasing position and release the socket assembly upon insertion of a releasing device into the socket assembly from below, the releasing device comprising an body having an width equal to the width of the flange of the socket assembly.

Another example is a quick-change housing including a housing defining an open end and an interior defining a central axis and configured to receive a socket comprising a flange extending radially from the socket, the socket being configured to secure and provide power to an illumination device, two or more clips located around an inner surface of the interior of the housing, and two or more compression members each arranged adjacent to the retaining end one of the clips along the central axis. Each clip defines a retaining end, and the clips are configured to move between a retaining position and a releasing position, such that the retaining end of the clips are deflected in a direction radially outward from the central axis and upward when moving from the retaining position to the releasing position. The compression members are moveably coupled to the housing and configured to translate along the central axis from an extended position in a direction away from the clips. Movement of the clips from the retaining position to the releasing position causes translation of the compression members from the extended position to a first compressed position. The clips are configured to accept the flange of a socket assembly inserted into the quick-change housing from below, the flange deflects the retaining ends of the clips from the retaining position to the releasing position and the clips deflect the compression members from the extended position to the first compressed position until the flange directly engages the compression members and further translates the compression members to a second compressed position. In the second compression position, the retaining ends of the clips return to the retaining position below the flange and secure the flange between the retaining ends and the compression members.

DETAILED DESCRIPTION

Figure 1A:
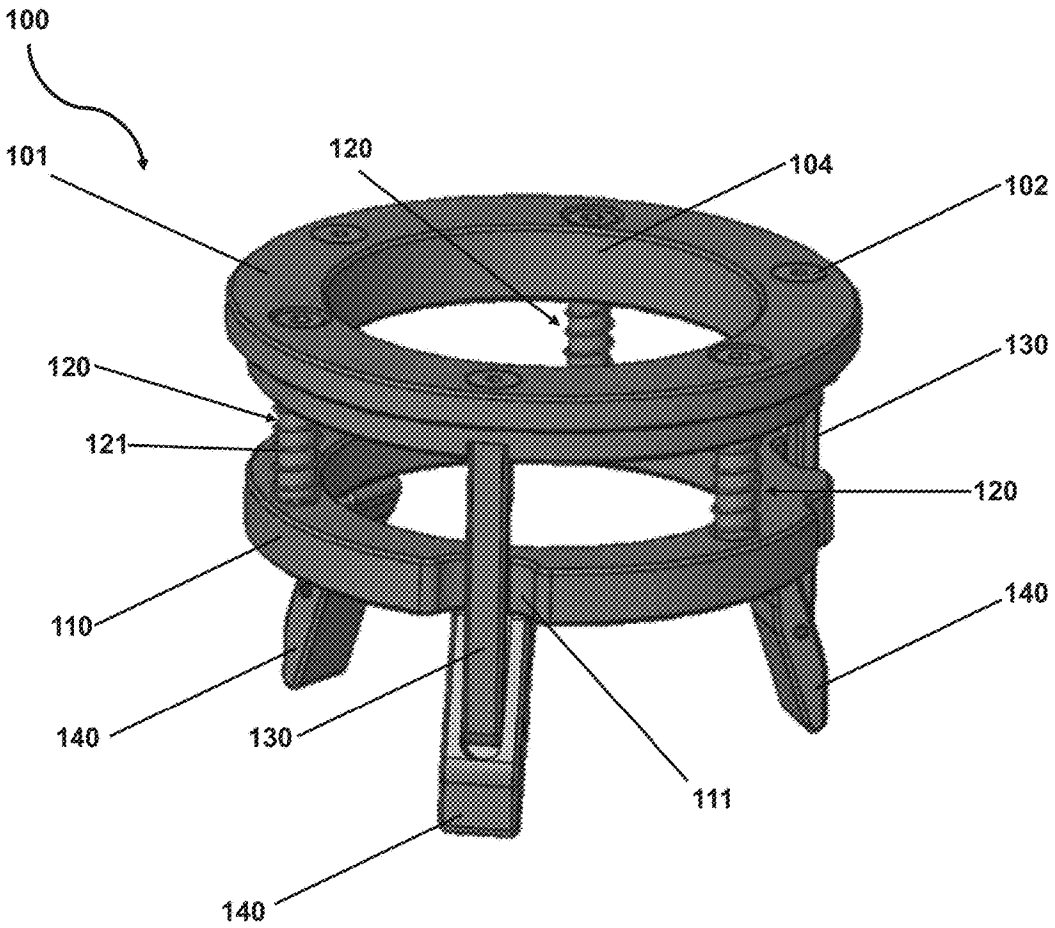
FIGS. 1A and 1B are illustrations of a quick-change assembly.
Figure 1B:
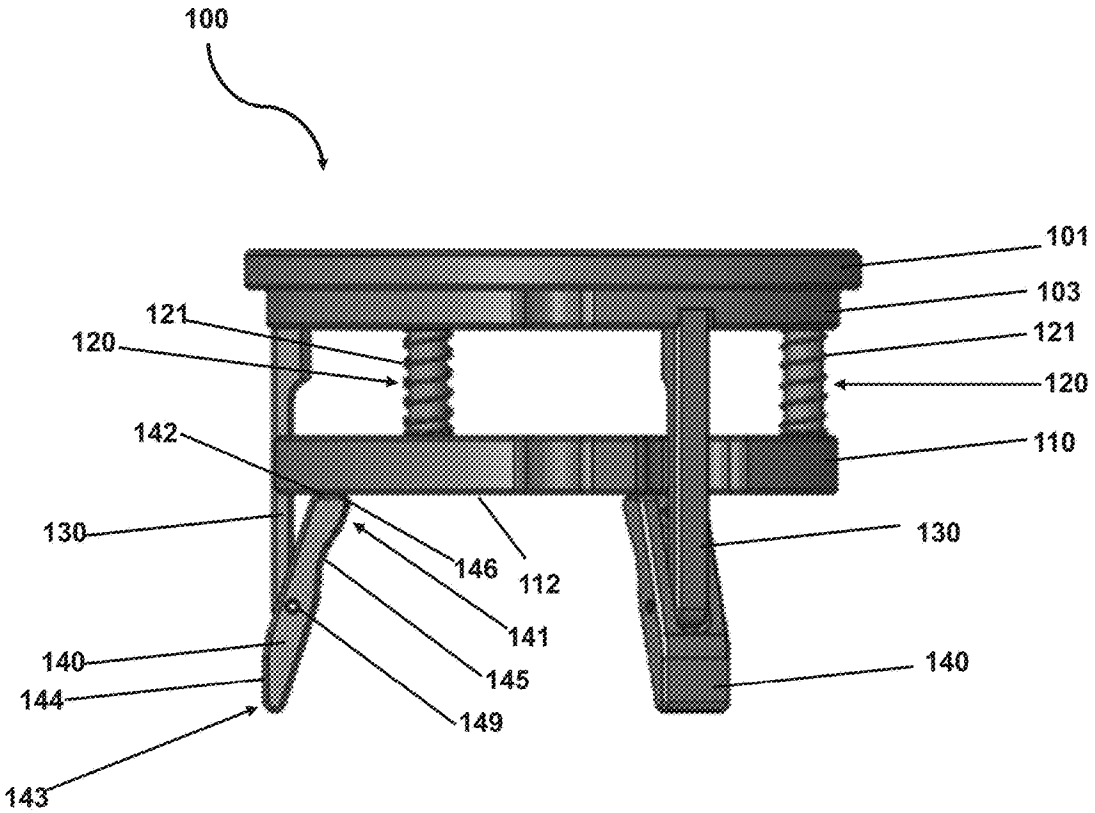

FIGS. 1A and 1B are illustration of a quick-change assembly. FIG. 1A is a perspective-view illustration of quick-change assembly 100 including a stationary ring 101, a compression ring 110, carrier arms 130, and retaining clips 140. The stationary ring 101 and the compression ring 110 define an opening 104 though the quick-change assembly 100. The retaining clips 140 are secured to the ends of the carrier arms 130 and the carrier arms 130 are attached to the stationary ring 101. The carrier arms 130 extend downwards from the stationary ring 101 and position the retaining clips 140 below the compression ring 110. To do so, the carrier arms 140 pass though cutouts 111 in the compression ring 110. The compression ring 110 is moveably coupled to the stationary ring 110 with pins 120 secure to the stationary ring 101, such that the compression ring 110 is able to translate along the pins 120 (i.e., along a central axis of the stationary ring 101). In some instances, and as illustrated in FIG. 1A, the pins 120 are surrounded by spring elements 121 that are configured to contact the compression ring 120 and the stationary ring 101 and thereby bias the compression ring 110 away from the stationary ring 101 and against the retaining clips 140. Fasteners 102 in the top of the stationary ring secure the pins 120 and the carrier arms 130 to the stationary ring 101.

FIG. 1B is a side-view illustration of the quick-change assembly 100 and highlights the additional structural features of the retaining clips 140 and the location of the compression ring 110. The stationary ring 101 includes a recessed region 103 configured to be inserted into a housing element 400 whereby an upper edge of the stationary ring 101 is above the housing and, for example, supports the weight of the quick-change assembly 100 and enables the quick-change assembly 100 to be dropped into an opening. In some instances, the quick-change assembly 100 is configured to be inserted completely into a housing element 400 thereby forming a quick change housing 402 (as shown, for example, in FIGS. 3A and 3B). In some instances, the quick-change assembly 100 is integrated with a housing element 400 or is otherwise supported by an exterior structure. The retaining clips 140 are configured to move between a retaining position and a releasing position by rotating about an axis 149 and the retaining clips 140 include a retaining end 141 and a bracing end 143 above and below the axis 149, respectively. The retaining end 141 includes a flat surface 142 and a rounded inner edge 146 and the bracing end 143 includes a bracing surface 144. The flat surface 142 is configured to abut the compression ring 110 in the retaining position, and the bracing surface 142 is configured to abut the housing or carrier arm 130 in the retaining position such that rotation of the retaining clip 140 beyond the retaining position is prevented. The inner surface of the retaining clip defines a depression above the axis of rotation 149. In some instances, and as shown in FIG. 1B, the axis 149 of the retaining clips 140 is along a rotational connection between the retaining clip 140 and the carrier arm 130.

FIG. 1B shows the retaining clips 140 in the retaining position, whereby the flat surfaces 142 of the retaining clips 140 are engaged with the compression ring 110. In the releasing position, the retaining clips 140 are rotated such that the retaining end 141 is deflected radially outward from the central axis, with the rounded inner edge 146 contacting the compression ring 110. Therefore, movement of the retaining clips 140 between the retaining position and the releasing position deflects the compression ring 110 towards the stationary ring 101. The flat surface 142 is configured to rest against the compression ring 110 in the extended position of the compression ring 110 and the rounded inner edge 146 contacts the compression ring 110 and moves radially outward across the compression ring 110 as the retaining end 141 of the retaining clip 140 rotates about the axis 149. In some instances, this movement of the compression ring 110 towards the stationary ring 101 is against a restoring force of the spring elements 121, which are configured to bias the compression ring 110 in the extended position. In some instances, the retaining clips 140 are spring biased in the retaining position or configured to return to the retaining position from the releasing position using gravity.

Figure 2B:
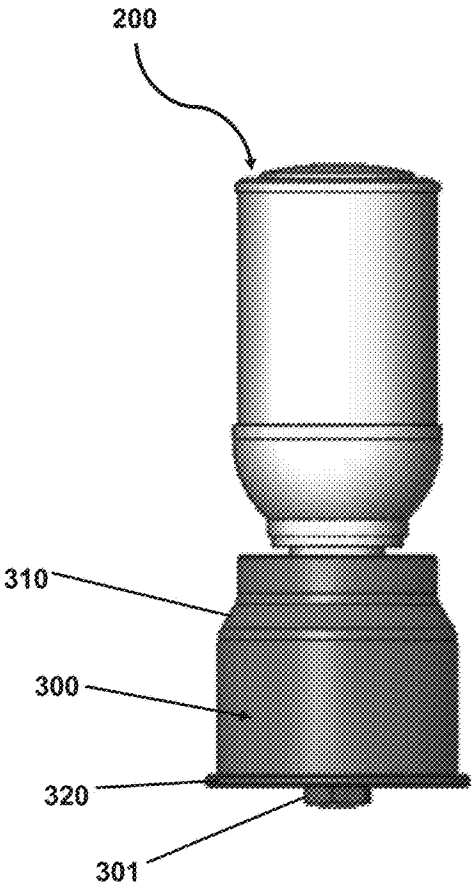
FIGS. 2A-2C are illustrations of an example socket assembly carrying a socket and an illumination device.
Figure 2A:
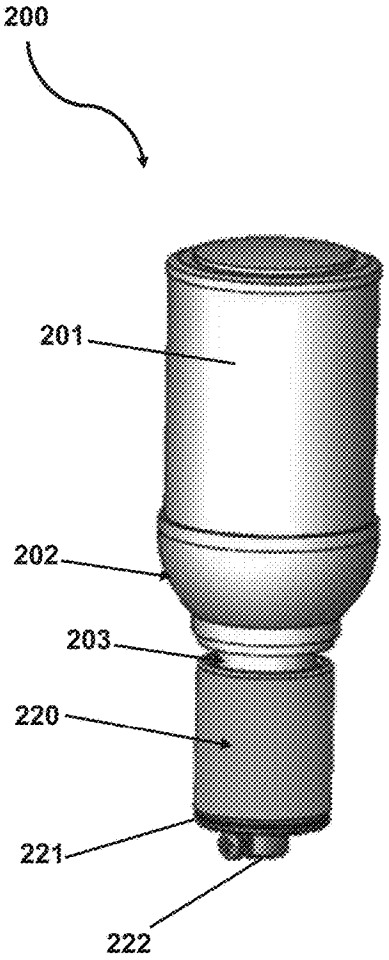
Figure 2C:
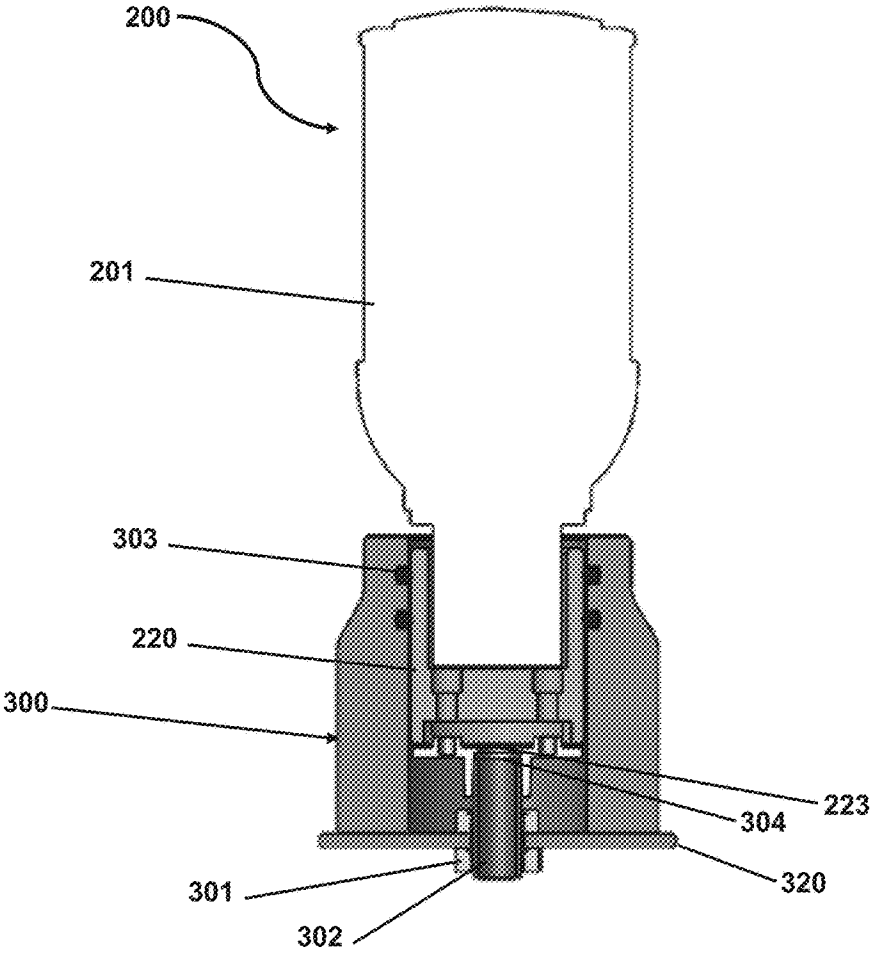
Figure 8A:
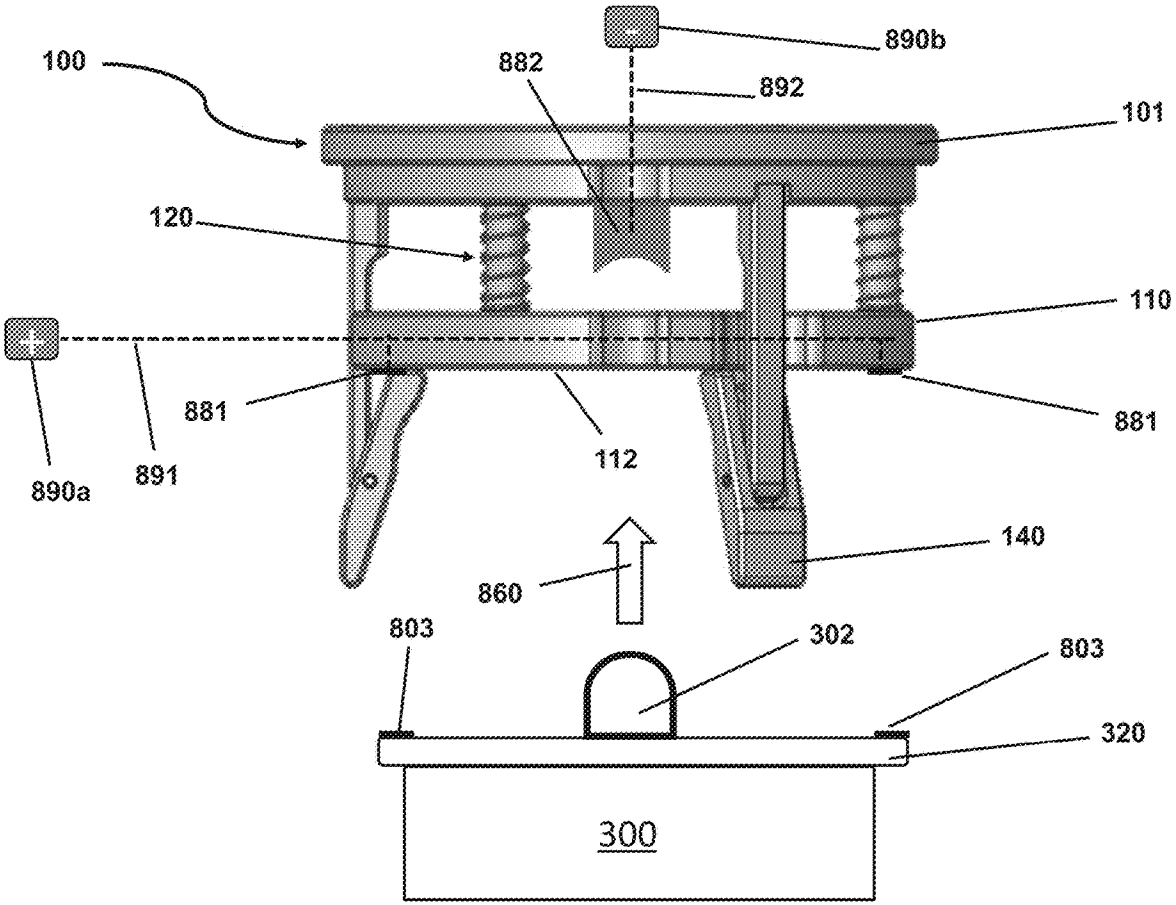
FIGS. 8A and 8B are illustrations of an example electric contact configuration of a quick change assembly and a socket assembly.
Figure 8B:
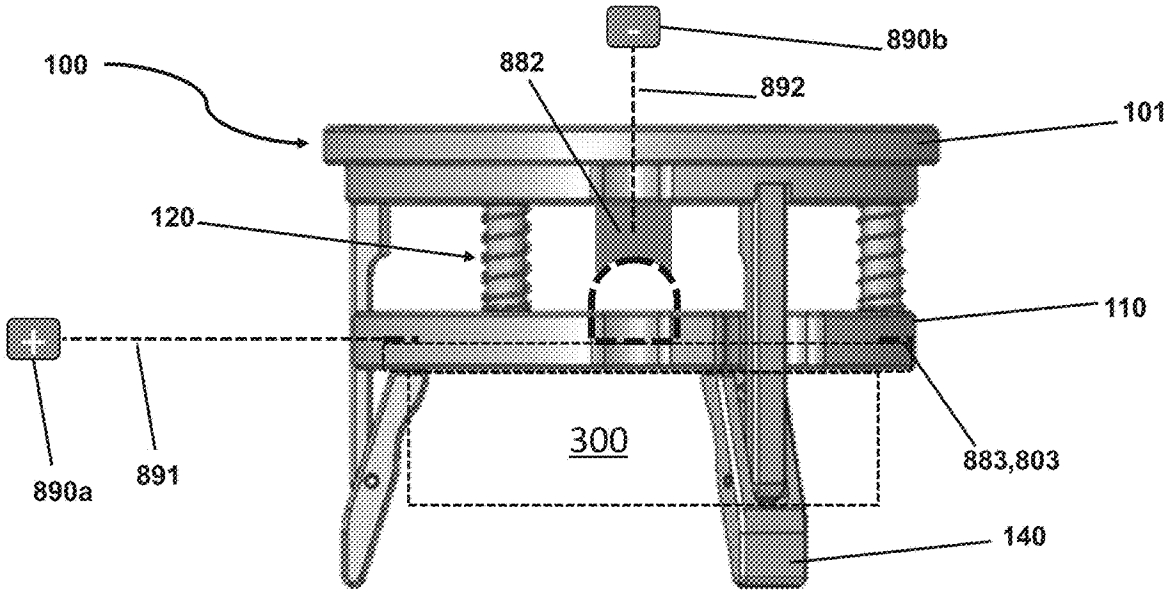

FIGS. 2A-2C are illustrations of an example socket assembly carrying a socket and an illumination device. FIG. 2A shows an illumination assembly 200 including an illumination device 201 installed in a socket 220. The illumination device 200 is a representative of a generic illumination device, having, for example, a ballast 202 and a plug 203 that includes electrical contacts for mating with corresponding contacts inside the socket 220. In some implementations, the illumination device 200 may have a conventional male screw thread that is received in a mating female screw thread in socket 220. The socket 220 includes exterior electric contacts 221, 222 for connecting the illumination device 200 to a source of electric power. FIG. 2B shows the illumination device 200 and socket 220 (not visible) disposed in a socket assembly 300. The socket assembly 300 includes a body having a beveled surface 310, a flange 320 defining the outermost edge of the socket assembly 300, and an electric contact 301 in communication with one or both of the electric contacts 221, 222 of the socket 220. FIG. 2C is a cross-section view of the illumination device 200 and socket assembly 300, showing a retaining mechanism (e.g., threads, rubber gasket, or similar element for securing the socket 220 into the socket assembly 300), and an conducting element 302 extending through the socket assembly 300 to contact electrically couple the electric contact 301 of the socket assembly 300 to one of the electric contacts 221, 222 of the socket and provide an electrical current pathway. FIGS. 8A and 8B show a more detail embodiment of the electrical contacts.

Figure 3B:
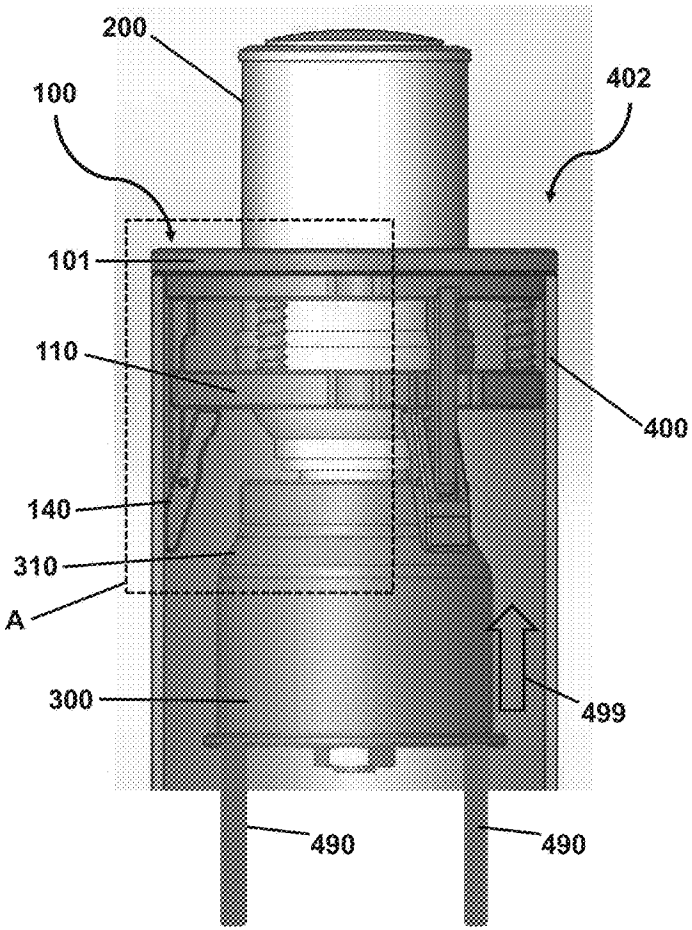
FIG. 3B is an illustrating of the socket assembly of FIGS. 2A-2C being inserted into the housing and quick-change housing of FIG. 3A.
Figure 3A:
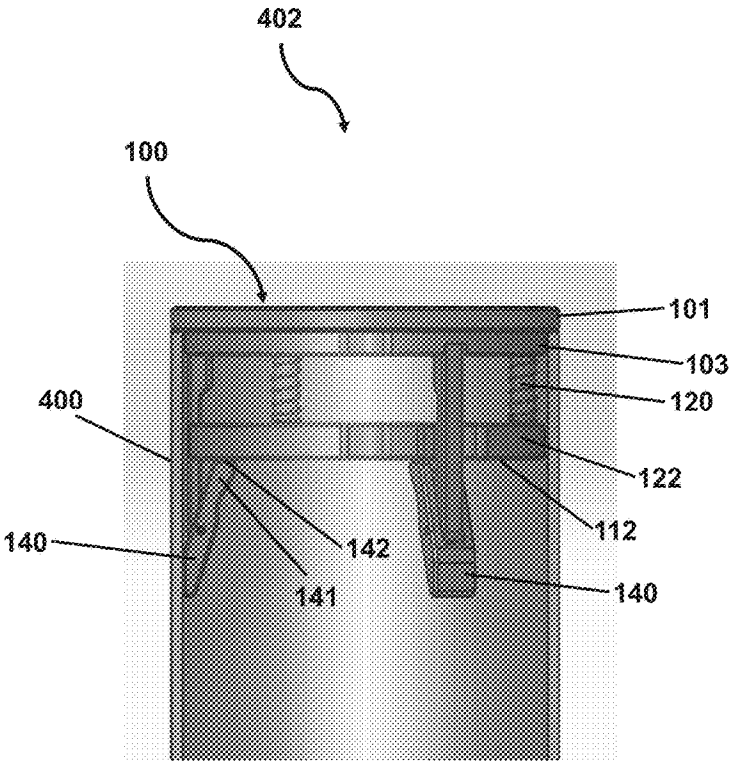
FIG. 3A is an illustrations of a quick change housing including the quick-change assembly of FIGS. 1A and 1B installed in a housing element.

FIG. 3A is an illustrating of the quick-change assembly 100 of FIGS. 1A and 1B installed in a housing element 400 to create the quick-change housing 402. FIG. 3A shows the quick-change assembly 100 in the housing element 400 with the recessed region of the stationary ring 103 inside the housing element 400 and the upper edge of the stationary ring 101 supporting the quick-change assembly 100. For example, FIG. 3A can represent the quick-change housing 402 100 installed on the top of a pole, above which an illumination device is to be installed (i.e., a light post). In some instances, the stationary ring 101 includes additional holes for connecting a diffuser around the illumination device 200 in the installed position above the quick-change assembly 100. FIG. 3A shows that the carrier arms 130 and the bracing surfaces 144 of the retaining clips 140 both rest against the inner surface of the housing element 400. In this configuration, weight supported by the retaining clips 140 is distributed directed into the housing element 400 as a radial component and also as a downward component (i.e., along the central axis of the quick-change assembly 100) along the carrier arms 130, which are supported by the housing element 400 via the stationary ring 101.

FIG. 3B is an illustration of the socket assembly of FIGS. 2A-2C being inserted into the quick change housing 402 of FIG. 3A. FIG. 3B shows an installation tool 490 supporting the socket assembly 300 and moving the socket assembly (as indicated by arrow 499) into the quick-change assembly 100 of the quick change housing 402. The illumination device 200 is shown passing through the openings 104 of the stationary ring 101 and the compression 130 and extending above the quick-change assembly 100. Eventually, the flange 320 of the socket assembly 300 will pass above the retaining clips 140, deflecting the outwards beforehand (i.e., from the retaining position to the releasing position), and, when the flange 320 has cleared the retaining ends 141 of the retaining clips 140, the retaining clips 140 returning to the retaining position below the flange 320 will secure the socket assembly 300 to the quick-change assembly 100 by securing the flange 320 between the compression ring 110 and the retaining surfaces 142 of the retaining clips. In the following FIGS. 4A-4E, the view of detail "A" is shown during the installation operation of the socket assembly 300 into the quick-change assembly 100 of the quick change housing 402.

Figure 4B:
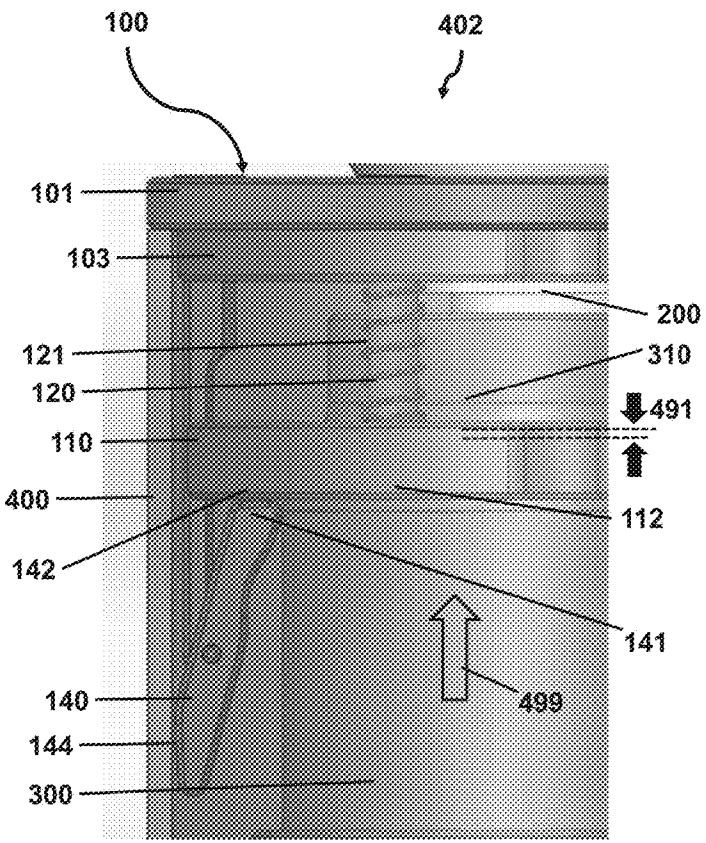
FIGS. 4A-4F are illustrations of the socket assembly of FIGS. 2A-2C being installed into the quick-change housing of FIG. 3A using an installation tool.
Figure 4A:
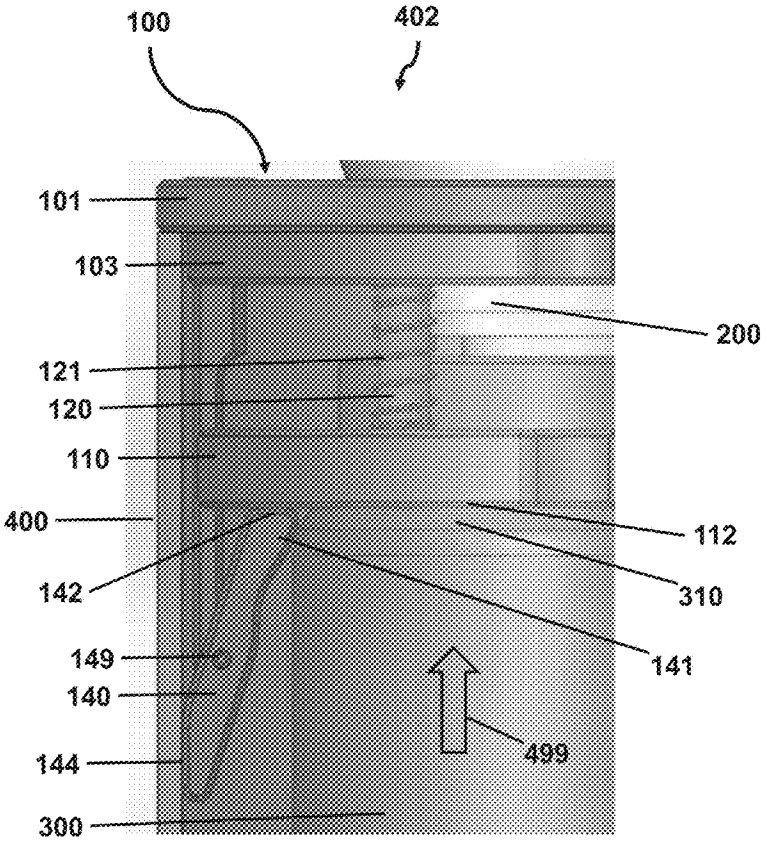
Figure 4D:
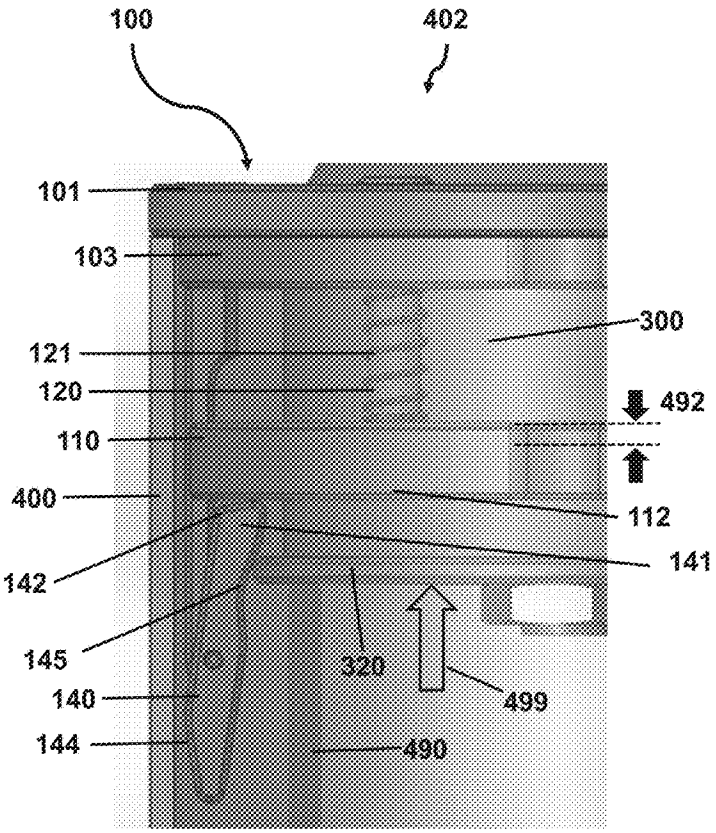
Figure 4C:
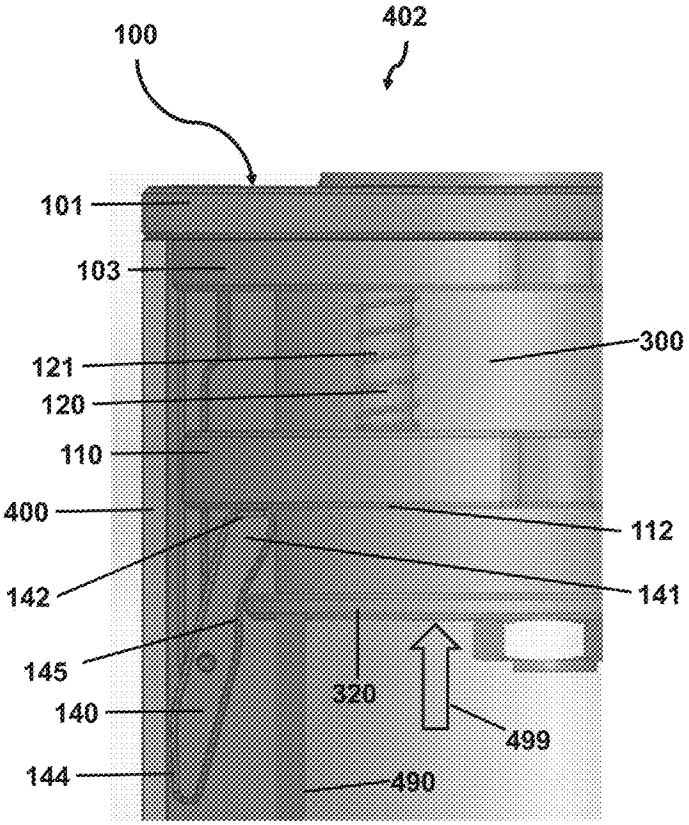
Figure 4F:
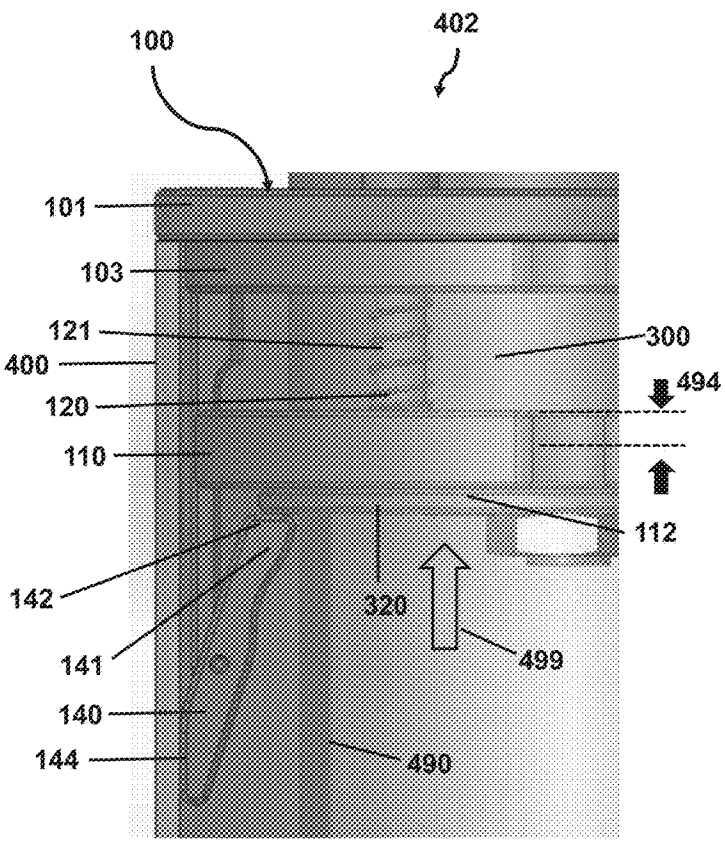

FIGS. 4A-4F are illustrations of the socket assembly 300 of FIGS. 2A-2C being installed into the quick-change assembly 100 of the quick change housing 402 of FIG. 3A using the installation tool 490. FIGS. 4A-4E illustrate the interactions between of the flange 320 of the socket assembly 300 and the clips 140 and compression ring 110 in order to retain the socket assembly 300 in the quick-change assembly 100. FIG. 4A shows the beveled surface 310 of the socket assembly 300 contacting the retaining clips 140, the flat surface 142 of which is abutted against the compression ring 110. Continued movement 499 of the socket assembly 300 deflects the retaining clips 140, which in turn deflects the compression ring 110 by the change 491 shown in FIG. 4B. FIG. 4B illustrates the retaining ends 141 of the retaining clips 140 being engaged with the body of the socket assembly 300 as the socket assembly 300 moves 499 into the quick-change assembly 100. Eventually, as shown in FIG. 4C, the flange 320 of the socket assembly 300 moves into the depression 145, after which, and as shown in FIG. 4D, the movement 499 of the socket assembly 300 causes the flange 320 to further move the retaining clips 140 towards their releasing position and thereby further deflect the compression ring 110 by the amount 492 shown in FIG. 4D. Continued movement of the socket assembly 300 results in additional movement of the compression ring 110 by the distance 493 shown in FIG. 4E, where the flange 320 has moved the retaining clips 140 completely into their releasing position. When the retaining clip 140 is in the releasing position, the flange 320 to free to move upwards past the rounded inner edge 146 of the retaining clips 140 and contact the compression ring 110, as shown in FIG. 4F.

In FIG. 4F, the socket assembly 300 has moved 499 upwards to directly engage the flange 320 against the compression ring 110 and further deflect the compression ring 110 until the retaining ends 141 are able to pass below the flange 320, at which point the retaining clips 140 will return to the retaining position because they are biased to do so (either by gravity or by some assisting force). In FIG. 4F, the flange 320 is secured between the retaining surface 142 of the retaining clips 140 and the compression ring 110, and the total deflection 494 of the compression ring 110 is therefore the thickness of the flange 320. The installation tool 490 is sized to fit inside the retaining clips 140 in their retaining position to avoid interference with the retaining clips 140 returning to the retaining position after the flange 320 passes above the retaining ends 141. In some instances, the installation tool 490 is a cup or a ring placed around or against the socket assembly and configured to evenly press the socket assembly 300 against and past the retaining clips 140.

Figure 4E:
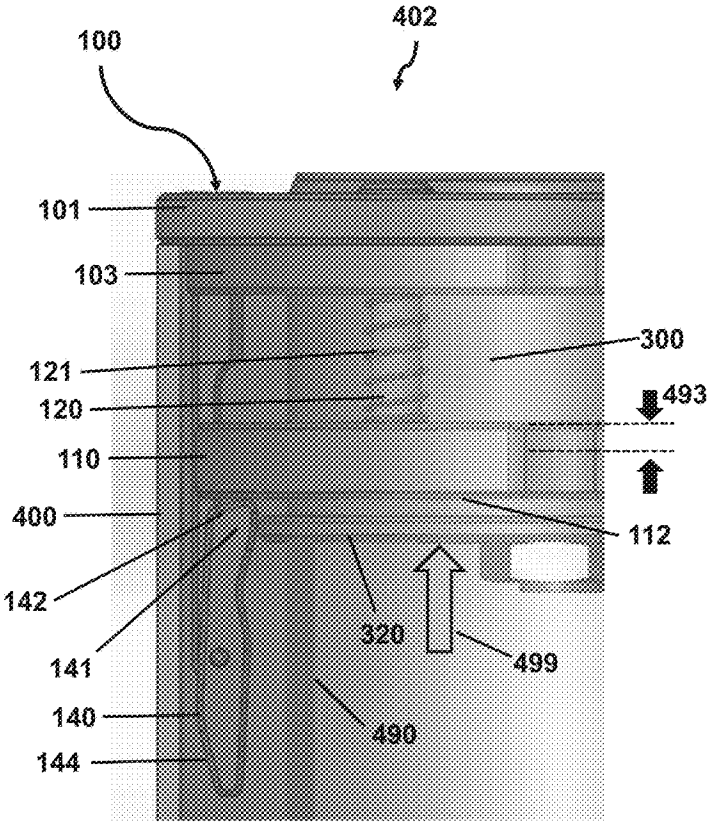

In some instances, the spring elements 121 are compressed by the compression ring 110 when the compression ring 110 is seated against the retaining clips 140 in their retaining position. In some instances, the total minimum restoring force applied by the spring elements 121 to the compression ring 110 (i.e., when the compressing ring 130 is in the extended position against the retaining clips 141 in their retaining position, as shown in FIG. 4A) is about 1 lbf. In some instances, the restoring force is higher (e.g., 2 lbf of more), and in some instances the restoring force is lower (e.g., 0.5 lbf or less). In some instances, the restoring force applied by the spring elements 121 to the compression ring 110 against the retaining clips 141 when the retaining clips 141 are deflected to their releasing position (as shown in FIG. 4E) is about 5 lbf. In some instances, the restoring force is higher or is lower, but generally higher than the restoring force against when the compression ring 110 is in the extended position against the retaining clips 141 due to the increased compression of the spring elements 121. In some instances, the maximum total restoring force applied by the spring elements 121 to the compression ring 110 when the compression ring is pushed above the retaining clips 141 in their releasing position is 6 lbf. In some instances, the maximum restoring force is higher or lower, but generally higher than the restoring force when the compression ring 110 is in a lower position (i.e., farther from the stationary ring 101). In some instances, the locking force (i.e., the force on the flange 320 when locked between the retaining clips 140 and the compression ring 110, as shown in FIG. 4F) applied by the spring elements 121 to the compression ring 110 against the flange 320 when the flange 320 is positioned between the retaining clips 141 in their retaining position and the compression ring 110 is about 2.5 lbf. In some instances, the locking force is higher or lower, but generally between the maximum restoring force and the minimum restoring force. One skilled in the art will appreciate that the restoring force of the spring elements 121 can be adjusted to provide the proper feel (i.e., the force profile of the insertion of the socket assembly 300 into the quick-change assembly 100) and security (i.e., the locking force determines how rigidly the socket assembly is coupled to the quick-change assembly 100) based on a plurality of factors. For example, for indoor applications, a heavy socket assembly 300 (including the weight of the illumination device 200 or other attached device) may not necessitate an increased locking force if the weight of the socket assembly 300 against the retaining clips 140 is sufficient to keep the socket assembly 300 safely attached, but in outdoor applications, where a heavier or larger socket assembly 300 may be exposed to wind forces or movement of the assembly to which the socket-assembly 300 is attached (e.g., a street light), then a stronger locking force may be used to limit movement of the installed socket assembly 300. However, one advantage of the quick-change assembly 100 is that the biasing of the retaining clips 140 in their retaining position makes it almost very difficult for an installed socket assembly 300 to break free or be removed from the quick-change assembly 100 without the retaining clips 140 all being moved to their releasing position. A specifically shaped removal tool, as illustrated in FIGS. 5A-5E, is shown being used to disengage the socket assembly 300 from the quick-change assembly 100 by being inserted into the quick-change assembly 100 and simultaneously deflecting all of the retaining clips 140 to their releasing position and freeing the socket assembly 300.

Figure 5A:
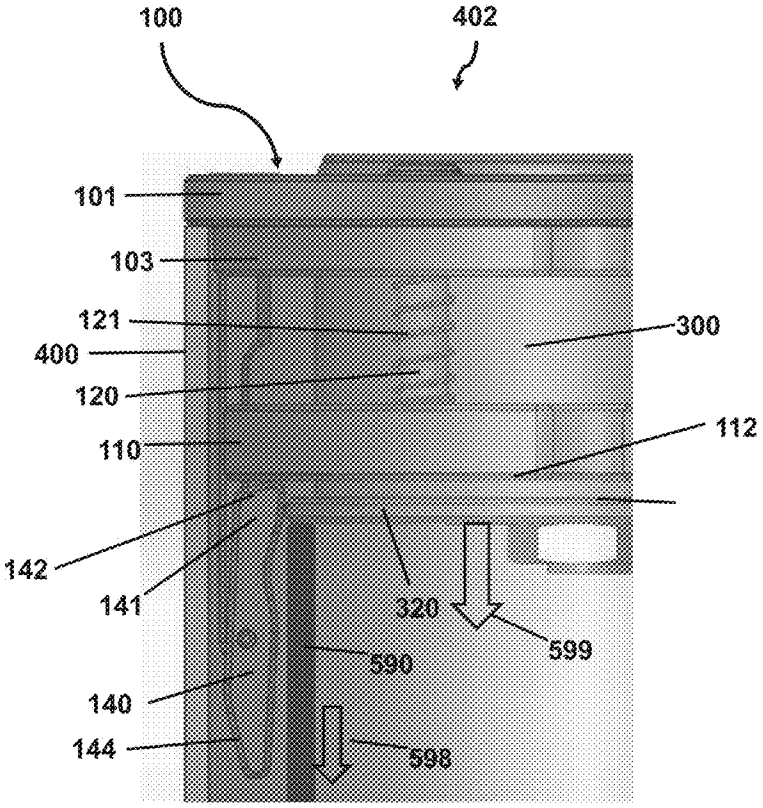
FIGS. 5A-5E are illustrations of the socket assembly of FIGS. 2A-2C being removed from the quick-change housing of FIG. 3A using a removal tool
Figure 5B:
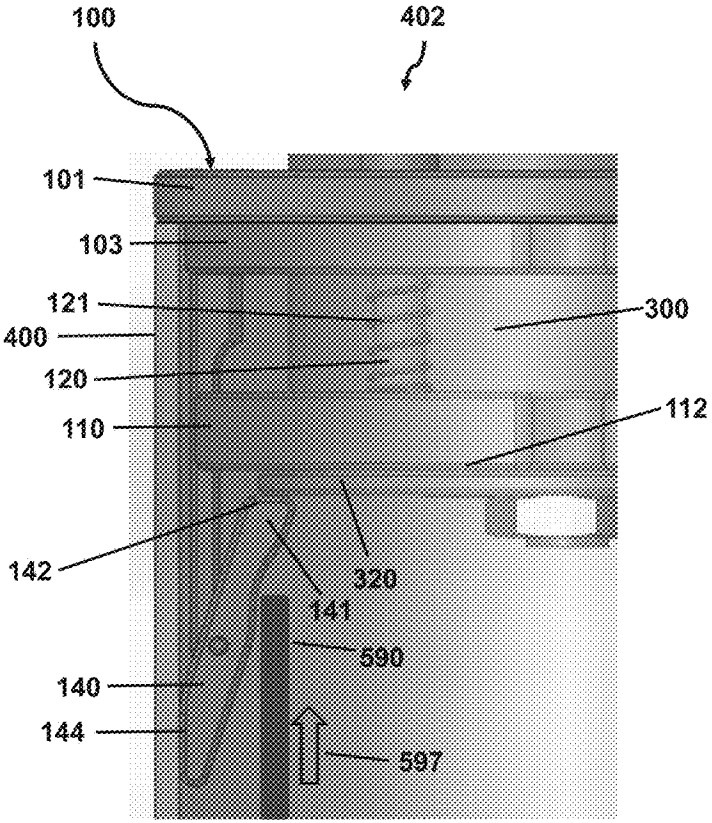

FIGS. 5A-5E are illustrations of the socket assembly 300 of FIGS. 2A-2C being removed from the quick-change assembly 100 of the quick change housing 402 of FIG. 3A using a removal tool 590. FIG. 5A shows the socket assembly 300 and quick-change assembly 100 in the installed configuration discussed above regarding FIG. 4E. FIG. 5A shows a removal tool 590 being inserted (as indicated by arrow 597) into the quick-change assembly 100 from below and in a position immediately prior to contacting the retaining clip 140. While not shown, the removal tool 590 is similarly position below the other retaining clips 140. For example, if the quick-change assembly 100 has a circular shape, as show in FIG. 1A, then the removal tool 590 may be a cup or ring that is sized to engage all of the retaining clips 140 when inserted into the quick-change assembly 100. The removal tool 590 is configured to contact the retaining clips 140 and move them from their retaining position to their releasing position, which moves the retaining end 141 of the retaining clips 140 past the outermost edge of the flange 320 of the socket assembly, as shown in FIG. 5B. The removal tool 590 is sized to have a same or substantially similar outer width (especially at the edge of the removal tool 590 where it contacts the flange 320) as the width of the flange 320 of the socket assembly. The similar width ensures that the retaining end 141 of the retaining clips 140 are deflected to the same position by the removal tool 590 as the retaining ends 141 were deflected by the flange 320 to allow the flange 320 to pass above the retaining ends 141 during installation (as illustrated in FIG. 4E).

In FIG. 5B, the removal tool 590 has deflected the retaining clips 140 to their releasing position, and as the removal tool 390 is moved downward (as indicated by arrow 598) the flange 320 of the socket assembly has moved (as indicated by arrow 599) downward to rest against the removal tool 590 as well. In some instances, the initial movement of the socket assembly 300 away from the compression ring 110 is driven primarily by gravity, but in some instances, the compression ring 110 or the socket assembly 300 may include spring tabs or other devices to provide an initial force to move the flange 320 below the rounded inner edge 146 of the retaining clips 140.

Figure 5D:
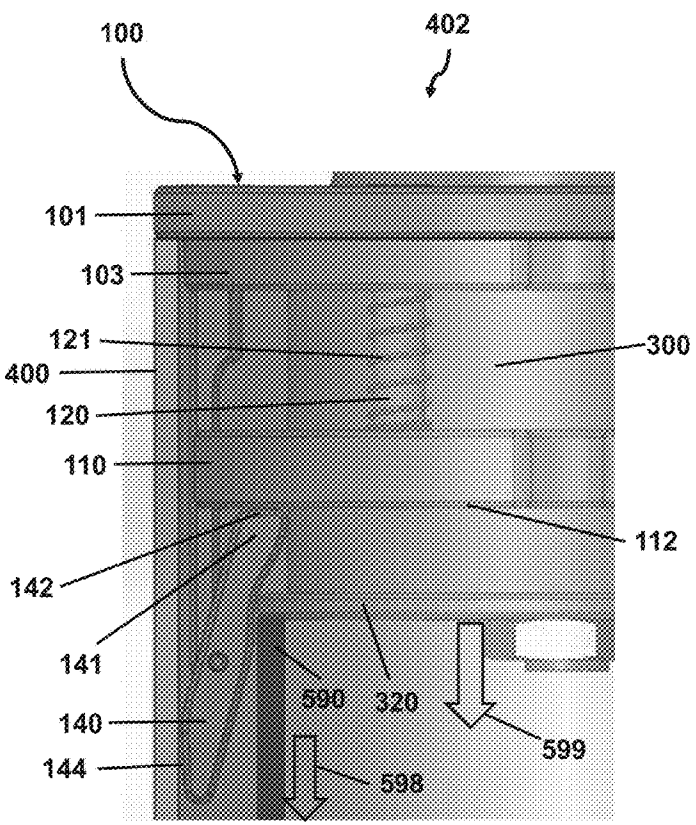
Figure 5C:
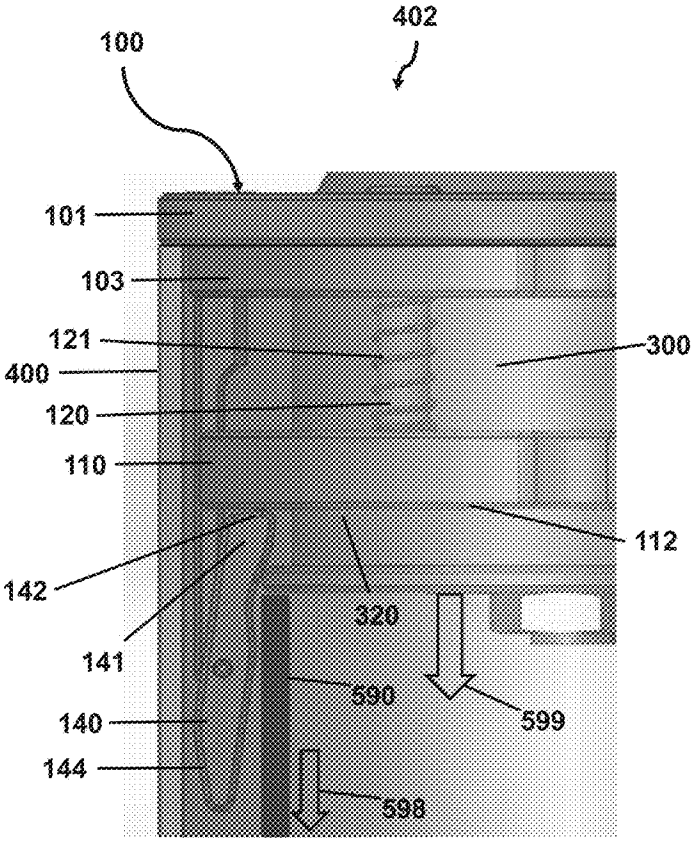
Figure 5E:
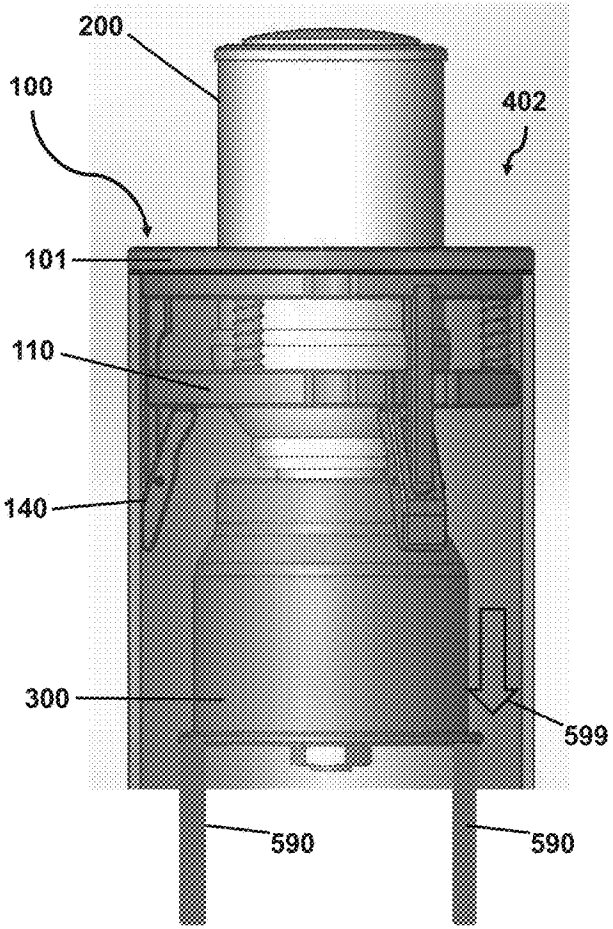

In the configuration shown in FIG. 5C, the socket assembly 300 is no longer secured in the quick-change assembly 100 and the removal tool 590 is supporting the socket assembly 300. In FIG. 5C, the flange 320 is below the rounded inner edge 146, and, in some instances, the spring biasing of the retaining clips 140 to return to their retaining position, in addition to the restoring force of the spring element 121 on the compression ring 110 against the retaining clips 140 squeezes the retaining ends 141 against the flange 320, which, due to the slanted inner profile of the retaining clips 140, applies a downward force on the socket assembly 320. In some instances, this downward force is tuned to avoid expelling the socket assembly 300 from the quick-change assembly 100 too quickly, while also ensuring the socket assembly 300 is not stuck due to any stiction between the retaining clips 140 and the edge of the flange 320. The depression 145 is, in some instances, configured to increase the downwards force on the flange 320 from the retaining clips 140 by increasing the angle of the inner surface of the retaining clips above the depression 145, thereby increasing the downwards component of the vector of the force applied to the flange 320 by the retaining clips. Continued downwards movement 598 of the removal tool 590 allows continued downward movement 599 of the socket assembly 300 until the configuration of FIG. 5D is reached. FIG. 5D illustrates the flange 320 has passed below the depression 145 and the retaining clips 140 have returned to their retaining position. Therefore, in FIG. 5D, the socket assembly 320 is no longer in contact with the quick-change assembly 100 and the removal tool 590 is free to lower the socket assembly 300 away from the quick-change assembly 100, as illustrated in FIG. 5E.

Figure 7:
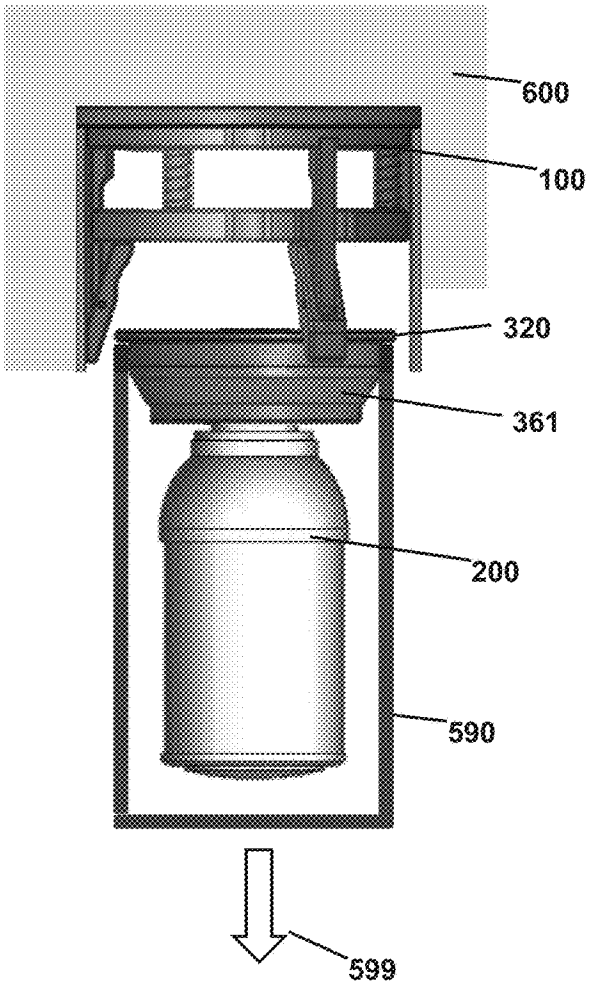
FIGS. 6 and 7 are illustrations of an alternate socket assembly designs configured to be use with the socket assembly of FIGS. 2A-2C in a ceiling-mounted configuration.
Figure 6:
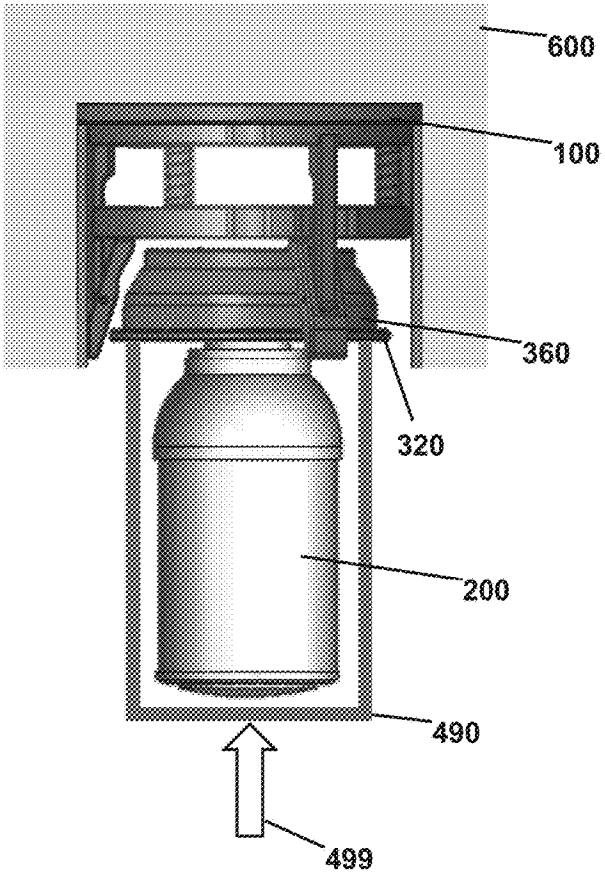

FIGS. 6 and 7 are illustrations of an alternate socket assembly design configured to be use with the illumination device 200 and socket 220 of FIGS. 2A-2C. FIG. 7 shows a quick-change assembly 100 installed in a ceiling 600. Alternatively, this alternate socket assembly could be used in a quick-change assembly 100 horizontally in a fixture secured to a pole when it is desired that the illumination shine downwardly. In this configuration, the stationary ring 101 may be, for example, a stationary plate that does not have an opening 104. Positioned below the quick-change assembly 100 is socket assembly 360 configured to support an illumination device 200 from below the ceiling-mounted socket assembly 360 wherein the illumination is shining downwardly. The ceiling-mounted socket assembly 360 is similar in function to the socket assembly 300 detailed above, and includes a flange 320. An installation tool 490 surrounds the illumination device 200 and is position to push 499 the flange 320 into quick-change assembly 100 to couple the ceiling-mounted socket assembly 360 to the quick-change assembly 100 in the same manner as the socket assembly detailed above with respect to FIGS. 4A-4F, except that the illumination device 200 is supported below the quick-change assembly 100, rather than above. In addition, FIG. 6 shows that a portion of the ceiling-mounted socket assembly 360 may extend though the compression ring 110 when the flange 320 is fully inserted and secured by the quick-change assembly 100.

Alternatively, and as shown in FIG. 7, an different design of a ceiling-mounted socket assembly 361 positions the flange 320 above the body of the ceiling-mounted socket assembly 361, and, in this configuration, the compression ring 110 does not need to have a central opening 104 and may, for example, be a compression plate or other solid element. FIG. 7 shows the illumination device 100 and the ceiling-mounted socket assembly 361 surrounded by a removal tool 590 in a position after the removal tool 590 has decoupled the ceiling-mounted socket assembly 360 from the quick-change assembly 100 and is removing 599 the ceiling-mounted socket assembly 360 and illumination device.

FIGS. 8A and 8B are illustrations of an example electric contact configuration of a quick change assembly and a socket assembly. FIG. 8A shows the quick change assembly 100 and socket assembly 300 in a position prior to insertion of the socket assembly 300 into the quick change assembly 100, along with an example electrical contact configuration to enable the socket assembly 300 to receive power from the quick change assembly 100. To do so, the socket assembly 300 includes two electrical contacts: an outer ring contact 803 arranged on the top side of the flange 320, and a central contact 302. Additionally, the quick change assembly 100 includes a corresponding outer ring contact 881 arranged on the bottom side of the compression ring 110 and a corresponding central contact 882 disposed in a central position in the quick change assembly.

In operation, when the flange 320 of the socket assembly 300 contacts the compression ring 110, the outer ring contact 803 and the corresponding outer ring contact 881 are placed in contact with each other. Then, upon the flange 320 being secured above the retaining clips 140, the central contact 302 contacts the corresponding central contact 882, as shown in FIG. 8B. In this position, a source of electrical power 890*a,b* is able to supply power to the socket assembly. In some instances, the source of electrical power 890*a,b* is connected to the quick change assembly 100 by wires 891,892 which run along the structures of the quick change assembly. In other instances, the source of electrical power 890*a,b* may be directly in contact with elements of the quick change assembly 100. For example, the compression ring 110 could be met of a conducting material and isolated from the stationary ring 101 such that that the bottom surface 112 of the compression ring 110 defines the corresponding central contact 882. In some instances, the corresponding central contact 882 is a flexible contact, or otherwise able to be deflected by the central contact 302 of the socket assembly 300 such that the socket assembly 300 contacts the corresponding central contact 882 prior to during insertion into the quick change assembly 100 in order to more robustly maintain electrical contact after insertion.

While FIGS. 8A and 8B have shown the quick-change assembly 100 as having electrical contacts to engage with a socket assembly arranged in a downward-facing configuration, one skilled in the art will appreciate that the quick-change assembly 100 could have a different location for the corresponding central contact 882 and enable two contact points to be created with a socket assembly inserted upright, such as in FIGS. 4A-4F. In some instances, the socket assembly 300 includes an annular contact point around the periphery of the body (e.g., around the beveled surface 310) to engage with a corresponding electrical contact of the quick change assembly 100 that is positioned above the compression ring 110 in a position to contact the an annular contact point on the socket assembly when the outer ring contact 803 engages with the corresponding outer ring contact 881. One skilled in the art will appreciate that the a multitude of different electrical contact configurations are enabled by the structure of the quick change assembly 100, which may vary depending on the shape and orientation of the socket assembly 300 to be retained.

While FIGS. 1A-8B have shown the quick-change assembly 100 as having a circular shape, one skilled in the art will appreciate that the quick-change assembly 100 could have a different shape and still function in the same manner, for example a rectangle or ellipse, and the location of the retaining clips 140 does not necessarily match the outer shape of the quick-change assembly 100. For example, a square quick-change assembly 100 may include a circular inner opening 104 with retaining clips 140 arrange in the same circular profile, as illustrated above in FIGS. 1A-7.

While FIGS. 1A-8B have shown the quick-change assembly 100 as having 3 retaining clips 140, one skilled in the art will appreciate that in some instances the may be only two retaining clips 140 or, in other instances, four or more. In addition, in some in the retaining clips 140 may be wider or shaped to contact the flange 320 with more surface area. In some instances, the retaining ends 141 of the retaining clips include features configured to rotationally contain the flange 320. In some instances, the compression ring 110 alone or in addition to the retaining clips 140 includes similar features configured to rotationally constrain the flange 320.

While FIGS. 1A-8B have shown the quick-change assembly 100 as having being configured to vertically hang the socket assembly 300, one skilled in the art will appreciate that in some instances the quick-change assembly 100 is orientated in any manner, as a gravity is not required except for the passive biasing of the retaining clips 140 in the retaining position in certain embodiments. However, spring biasing the retaining clips 140 in their retaining position is a more robust configuration even in vertical applications, as it may ensures faster movement of the retaining clips 140 from their releasing position to their retaining position when the flange 320 is pushed above the retaining ends 141 during installation. In some instances, the removal and installation tool includes magnets or other fastening means to secure the socket assembly 300 to the tools during installation and removal from the quick-change assembly 100.

While FIGS. 1A-8B have shown the quick-change assembly 100 as having being configured to only secure an illumination device 200 to the quick-change housing 100, one skilled in the art will appreciate that in some instances the quick-change assembly 100 includes an electrical contact or electric connection enabling power to be supplied to the socket assembly 300 or direction to the illumination device 100 (e.g., wirelessly).

While FIGS. 1A-8B have shown the compression ring 110 as a solid structure, one skilled in the art will appreciate that in some instances the quick-change assembly 100 includes individual compression elements positioned above the retaining clips 140 that function in the same manner. In some instances, these compression elements are integrated with the carrier arms.

While FIGS. 1A-8B have shown the retaining clips 140 as connected to the stationary ring 101, which is independent from the housing element 400, one skilled in the art will appreciate that in some instances the housing element 400 includes the retaining clips 140 attached to an inner surface of the housing element 400 and the stationary ring 101 and the compression ring 110 are configured to be inserted into the housing element 400. In some instances, the housing element 400 and the stationary ring 101 are integrally formed to define a housing assembly to which the retaining clips 140 and the compression ring 110 are moveably attached.

While FIGS. 1A-8B have shown the flange 320 of the socket assembly 300 as a radial flange around the periphery of the socket assembly, one skilled in the art will appreciate that in some instances the flange 320 is indentations or ledges formed in the outer surface of the socket assembly 300 such that the indentations must align with the retaining clips 140 in order for the socket assembly 300 to be secure in the quick-change assembly 100. In such a configuration, the socket assembly 300 can be inserted to a specific depth into the quick-change assembly 100 in any orientation, but must be rotated around the central axis until the retaining clips 140 are aligned with the indentations, thereby allowing the retaining clips 140 to return to the retaining position and secure the socket assembly 300. In this configuration, rotation of the socket assembly 300 about the central axis once installed may be reduced or eliminated due to the inability of the retaining clips 140 to move from the indentations in the socket assembly 300.

Those of skill in the art will understand that modifications (such as, for example, adjustments, additions, or removals) of various components of the apparatuses, methods, systems, devices, and embodiments described herein may be made without departing from the full scope and spirit of the present inventive concepts, which encompass such modifications and any equivalents thereof.

A number of implementations of the present disclosure have been described. Nevertheless, it will be understood that various modifications may be made without departing from the spirit and scope of the present disclosure. Accordingly, other implementations are within the scope of the following claims.

What is claimed is:

1. A quick-change lighting assembly, comprising:

a quick-change assembly including:

a stationary member defining a central axis;

a plurality of clips, each clip having a retaining end, wherein the clips are configured to move between a retaining position and a releasing position, and wherein the retaining ends of the clips are deflected in a direction radially outward from the central axis and upward when moving from the retaining position to the releasing position; and a compression member arranged between the stationary member and the plurality of clips along the central axis, the compression member moveably coupled to the stationary member and configured to translate along the central axis towards the stationary member from an extended position;

a socket assembly including:

a body having a flange; and a socket adapted to receive an illumination device;

wherein the plurality of clips are configured to accept the flange of the socket assembly inserted into the quick-change assembly from below, when inserted, the flange deflecting the retaining ends of the plurality of clips from the retaining position to the releasing position until the socket assembly directly engages the compression member and further translates the compression member to a final compressed position wherein, in the final compressed position, the retaining ends of the plurality of clips are configured to return to the retaining position below the flange and secure the flange between the retaining ends and the compression member.

2. The quick-change lighting assembly of claim 1, wherein the stationary member comprises a plurality of carrier arms extending in a downward direction from the stationary member and each of the plurality of clips is attached one of the plurality of carrier arms.

3. The quick-change lighting assembly of claim 1, wherein movement of the plurality of clips from the retaining position to the releasing position causes the retaining ends of the clips to contact the compression member and translate the compression member from the extended position to an intermediate compressed position, and wherein during insertion of the flange of the socket assembly, the deflection of the plurality of clips by the flange deflects the compression member from the extended position to the intermediate compressed position until the flange directly engages the compression member and the socket assembly further translates the compression member to the final compressed position.

4. The quick-change lighting assembly of claim 3, wherein, in the extended position, the retaining ends of the clips abut the compression member.

5. The quick-change lighting assembly of claim 4, wherein, in the extended position, the compression member is configured to exert a restoring force against the retaining ends of the clips.

6. The quick-change assembly of claim 1, comprising a spring element configured to bias the compression ring in the extended position and configured to enable translation of the compressing member towards the stationary member along the central axis against a restoring force of the spring element.

7. The quick-change lighting assembly of claim 1, wherein each of the plurality of clips comprises a spring element biasing the clip in retaining position.

8. The quick-change lighting assembly of claim 1, wherein the retaining ends of the plurality of clips are configured to return to the retaining position using gravity.

9. The quick-change lighting assembly of claim 1, wherein each of the plurality of clips defines a bracing end opposite the retaining end and an axis of rotation between the retaining end and the bracing end, wherein the clips are configured to rotate about the axis of rotation between the retaining position and the releasing position, and wherein the bracing end is configured to stop rotation of the clip in the retaining position.

10. The quick-change lighting assembly of claim 9, wherein the bracing end of the clips comprises a surface configured to abut the carrier arm or an inner surface of a housing in which the quick-change assembly is disposed to stop rotation of the clip beyond the retaining position.

11. The quick-change lighting assembly of claim 9, wherein each of the plurality of clips defines an inner surface defining a depression located above the axis of rotation, the depression configured to accept an edge of the flange of the socket assembly and enable the flange of the socket assembly to deflect the clip at location higher above the axis of rotation compared to a flat inner surface.

12. The quick-change lighting assembly of claim 1, wherein the compression member defines a circular peripheral shape and the stationary member defines a circular peripheral shape, wherein the quick-change assembly is configured to be installed in a circular housing.

13. The quick-change lighting assembly of claim 1, wherein the retaining ends of the plurality of clips define an opening of a first width in the retaining position and an opening of a second width in the releasing position, wherein the second width is larger than the first width, and wherein flange of the socket assembly is larger than the first width and smaller than or equal to the second width.

14. The quick-change lighting assembly of claim 1, wherein the first width is a first diameter of the opening defined by the plurality of clips in the retaining position and wherein the second width is a second diameter of the opening defined by the plurality of clips in the releasing position.

15. The quick-change lighting assembly of claim 14, wherein the compression member comprises a compression ring defining a central opening configured to accept a portion the socket assembly extending above the flange, and wherein the central opening defines a diameter less than the second diameter of the opening defined by the plurality of clips in the releasing position.

16. The quick-change lighting assembly of claim 1, wherein the compression member defines a central opening configured to accept a portion the socket assembly extending above the flange.

17. The quick-change lighting assembly of claim 16, wherein the stationary member defines a central opening configured to accept the portion of the socket assembly extending above the flange.

18. The quick-change lighting assembly of claim 16, wherein the compression member comprises a compression ring.

19. The quick-change lighting assembly of claim 1, wherein the stationary member defines a peripheral edge, and wherein the carrier arms extend from the stationary member at the peripheral edge.

20. The quick-change lighting assembly of claim 1, wherein the retaining ends of the plurality of clips are configured to be deflected by the body of the socket assembly prior to being further deflected by the flange of the socket assembly, wherein the body of the socket assembly defines a width less than a width of the flange of the socket assembly.

21. The quick-change lighting assembly of claim 1, wherein the retaining ends of the plurality of clips define a flat surface having a rounded inner edge, the flat surface configured to abut the compression member in the retaining position and the rounded inner edge configured to abut the compression member in the releasing position, the rounded inner edge moving radially across the compression member between the retaining position and the releasing position.

22. The quick-change lighting assembly of claim 1, wherein the compression member defines a plurality of passageways though which the carrier arms extend below the compression member and enable the compression member to translate along the central axis with respect to the carrier arms.

23. The quick-change lighting assembly of claim 1, wherein, when the flange of the socket assembly is disposed between the retaining end of the plurality of clips and the compression member, the plurality of clips are configured to move from the retaining position to the releasing position and release the socket assembly upon insertion of a releasing device into the socket assembly from below, the releasing device comprising an body having an width equal to the width of the flange of the socket assembly.

24. A quick-change housing, comprising:

a housing defining an open end and an interior defining a central axis and configured to receive a socket comprising a flange extending radially from the socket, the socket being configured to secure and provide power to an illumination device;

two or more clips located around an inner surface of the interior of the housing, each clip defining a retaining end, wherein the clips are configured to move between a retaining position and a releasing position, and wherein the retaining end of the clips are deflected in a direction radially outward from the central axis and upward when moving from the retaining position to the releasing position;

two or more compression members each arranged adjacent to the retaining end one of the clips along the central axis, the compression members moveably coupled to the housing and configured to translate along the central axis from an extended position in a direction away from the clips, wherein movement of the clips from the retaining position to the releasing position causes translation of the compression members from the extended position to a first compressed position; and wherein the clips are configured to accept the flange of a socket assembly inserted into the quick-change housing from below, the flange deflecting the retaining ends of the clips from the retaining position to the releasing position and the clips deflecting the compression members from the extended position to the first compressed position until the flange directly engages the compression members and further translates the compression members to a second compressed position wherein, in the second compression position, the retaining ends of the clips return to the retaining position below the flange and secure the flange between the retaining ends and the compression members.

25. A method of installing a socket assembly into a quick-change lighting assembly, the method comprising:

inserting the socket assembly into the quick-change lighting assembly in a forwards direction, a flange of the socket assembly contacting a plurality of clips disposed around a periphery of the quick-change lighting assembly;

continuing to insert the socket assembly forwards and deflecting a retaining end of the plurality of clips radially outward and forwards until the flange passes beyond the retaining end;

prior to the flange passing beyond the retaining end of the clips, the socket assembly deflecting a compression ring, the compression ring applying a force against the socket assembly in a backwards direction;

after the flange passes beyond the retaining end of the clips, the retaining ends move radically inward behind the flange and the compression ring moving the flange backwards against the retaining end of the clips; and the compression retaining the socket assembly in the quick-change lighting assembly by securing the flange between the compression ring and the retaining ends of the clips.

26. A method of removing a socket assembly from a quick-change lighting assembly, the method comprising: inserting a tool into the quick-change lighting assembly in a forwards direction, the tool contacting a plurality of clips disposed around a periphery of the quick-change lighting assembly, the clips contacting and retaining a flange of the socket assembly against a compression ring of quick-change housing; continuing to insert the tool forwards, the tool deflecting a retaining end of the plurality of clips radially outwards and forwards until the retaining ends are deflected to a position radially beyond the flange thereby freeing the socket assembly; prior to the flange being freed from the retaining end of the clips, the deflecting of the clips radically forwards causing the socket assembly to move forwards and deflect the compression ring; and after retaining ends are deflected to a position radially beyond the flange, moving the tool in a backwards direction and removing the socket assembly from the quick-change assembly.

* * * * *